US008746411B2

(12) United States Patent
Roberts et al.

(10) Patent No.: US 8,746,411 B2
(45) Date of Patent: Jun. 10, 2014

(54) ELEVATOR CAR POSITIONING INCLUDING GAIN ADJUSTMENT BASED UPON WHETHER A VIBRATION DAMPER IS ACTIVATED

(75) Inventors: Randall Keith Roberts, Hebron, CT (US); Leandre Adifon, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 432 days.

(21) Appl. No.: 13/131,931

(22) PCT Filed: Dec. 5, 2008

(86) PCT No.: PCT/US2008/085647

§ 371 (c)(1),
(2), (4) Date: May 31, 2011

(87) PCT Pub. No.: WO2010/065041

PCT Pub. Date: Jun. 10, 2010

(65) Prior Publication Data

US 2011/0233004 A1 Sep. 29, 2011

(51) Int. Cl.
*B66B 1/42* (2006.01)

(52) U.S. Cl.
USPC ..... 187/284; 187/291; 187/393

(58) Field of Classification Search
USPC ..... 187/247, 289, 391–393, 282–284, 187/291–293; 318/757, 758, 460, 461, 468, 318/362, 369
See application file for complete search history.

(56) References Cited

U.S. PATENT DOCUMENTS

| | | | | | |
|---|---|---|---|---|---|
| 4,194,594 | A * | 3/1980 | Ishii et al. | ..... | 187/284 |
| 4,785,914 | A * | 11/1988 | Blain et al. | ..... | 187/280 |
| 5,526,902 | A * | 6/1996 | Gausachs et al. | ..... | 187/263 |
| 5,677,519 | A * | 10/1997 | Herkel et al. | ..... | 187/291 |
| 5,824,975 | A * | 10/1998 | Hong | ..... | 187/292 |
| 5,880,416 | A * | 3/1999 | Colby et al. | ..... | 187/393 |
| 5,959,266 | A * | 9/1999 | Uchiumi | ..... | 187/292 |
| 6,089,355 | A * | 7/2000 | Seki et al. | ..... | 187/292 |
| 6,283,252 | B1 * | 9/2001 | Lee | ..... | 187/291 |
| 6,318,505 | B1 | 11/2001 | De Angelis | | |
| 7,360,630 | B2 * | 4/2008 | Brant | ..... | 187/284 |
| 7,621,377 | B2 * | 11/2009 | Husmann | ..... | 187/292 |
| 7,699,145 | B2 | 4/2010 | Ericson | | |
| 8,141,685 | B2 * | 3/2012 | Utsunomiya | ..... | 187/292 |
| 8,360,209 | B2 * | 1/2013 | Roberts | ..... | 187/291 |

FOREIGN PATENT DOCUMENTS

| | | | |
|---|---|---|---|
| GB | 2313926 | A | 10/1997 |
| WO | 2005044710 | A1 | 5/2005 |

OTHER PUBLICATIONS

International Preliminary Report on Patentability for International application No. PCT/US2008/085647 mailed Jun. 16, 2011.
Chinese Search Report for Application No. 2008801322626 dated May 8, 2013.

* cited by examiner

*Primary Examiner* — Anthony Salata
(74) *Attorney, Agent, or Firm* — Carlson, Gaskey & Olds

(57) ABSTRACT

An exemplary method of controlling elevator car position includes determining that an elevator car requires re-leveling and determining whether a vibration damper is activated. A gain for controlling operation of a motor responsible for moving the elevator car for the re-leveling is adjusted if the vibration damper is activated.

19 Claims, 3 Drawing Sheets

ELEVATOR CAR POSITIONING INCLUDING GAIN ADJUSTMENT BASED UPON WHETHER A VIBRATION DAMPER IS ACTIVATED

BACKGROUND

Elevator systems include an elevator car that moves between various landings to provide elevator service to different levels within a building, for example. A machine includes a motor and brake for selectively moving the elevator car to a desired position and then maintaining the car in that position. A machine controller controls operation of the machine to respond to passenger requests for elevator service and to maintain the elevator car at a selected landing in a known manner.

One challenge associated with elevator systems is maintaining the car at an appropriate height relative to a landing to facilitate easy passage between the elevator car and a lobby where the elevator car is parked. The car floor is ideally kept level with the landing floor to make it easy for passengers to move between the lobby and the elevator car while minimizing the possibility of someone tripping. Current elevator codes define a displacement threshold that establishes a maximum difference that is allowable between the landing floor and the elevator car floor. When that distance is above the code threshold, the elevator system must re-level or correct the position of the elevator car.

The conventional elevator re-leveling approach includes sensing the amount of car-to-floor displacement. This is typically accomplished using an encoder on the primary position transducer or on other rotative parts associated with the elevator car. When the displacement exceeds a set threshold, a re-leveling process begins. The machine controller makes a determination regarding the weight of the car and pre-torques the motor for lifting the car before releasing the machine brake. The motor current is then controlled using a fixed gain feedback compensator on the position error.

The conventional approach to re-leveling an elevator car works well in most situations. In some high rise buildings that are higher than 120 m, for example, the conventional approach may not provide satisfactory results. This occurs, in part, because the effective stiffness of elevator roping members decreases proportionally with their length. Accordingly, a longer elevator roping arrangement allows for increased amounts of static deflection responsive to changing loads on the elevator car, which results from passengers entering or exiting the car, for example. Additionally, there is time delay between motor action, car reaction and position transducer response. Such a delay introduces potential stability issues in the position feedback logic associated with the conventional approach. Another issue is that the reduced stiffness of the roping arrangement reduces the resonant frequency associated with elevator car bounce resulting from changes in the load on the car. The lower frequency resonance creates a limitation on traditional control logic gains, which limits bandwidth and, therefore, performance.

SUMMARY

An exemplary method of controlling elevator car position includes determining that an elevator car requires re-leveling and determining whether a vibration damper is activated. A gain for controlling operation of a motor responsible for moving the elevator car for the re-leveling is adjusted if the vibration damper is activated.

An exemplary elevator system comprises a vibration damper that is configured to resist vertical movement of an associated elevator car. A controller device controls a motor configured to move the associated elevator car. The controller device includes a velocity servo having a gain with a set baseline value. The controller device is configured to selectively adjust the gain of the velocity servo from the set baseline value during a re-leveling of the associated elevator car if the vibration damper is activated.

The various features and advantages of this invention will become apparent to those skilled in the art from the following detailed description. The drawings that accompany the detailed description can be briefly described as follows.

DETAILED DESCRIPTION

Figure 1:
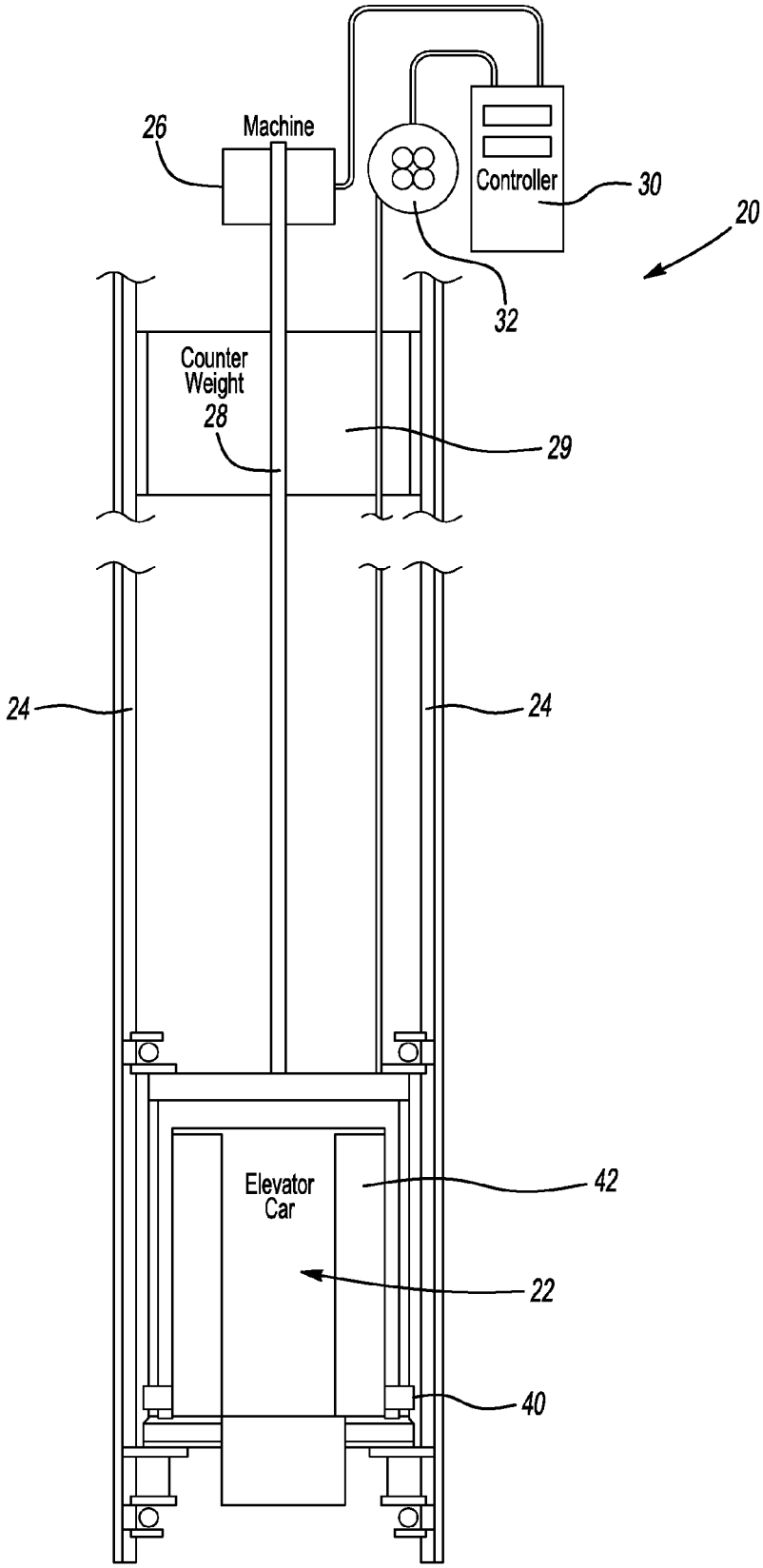
FIG. 1 schematically shows selected portions of an example elevator system.

FIG. 1 schematically illustrates selected portions of an example elevator system 20. An elevator car 22 is supported for movement along guide rails 24 responsive to operation of an elevator machine 26. In this example, the elevator machine 26 is responsible for controlling movement of a roping arrangement 28 that supports the weight of the elevator car 22 and a counterweight 29. The roping configuration may include any known roping ratio, such as the traditional 1:1 or 2:1 roped systems, for example. A motor and brake of the machine 26 operate responsive to an elevator machine controller 30 to achieve the desired movement and positioning of the elevator car 22.

The controller 30 utilizes information regarding operation of the machine 26 and information regarding a position of the elevator car 22 for determining how to control the machine 26 to achieve desired elevator system operation. The example of FIG. 1 includes a primary position transducer 32 that provides information to the controller 30 regarding the position of the elevator car 22. For example, the primary position transducer 32 comprises an encoder wheel and a rope or tape that moves with the elevator car 22 such that the encoder wheel provides information to the controller 30 that indicates a current position of the elevator car. The information regarding the position of the elevator car 22 can be determined in any known manner.

The controller 30 includes a velocity servo that is used for controlling operation of the motor of the machine 26. The velocity servo has a re-leveling gain ($K_{rl}$) and proportional ($K_p$) and integral ($K_i$) gains that control the motor torque signals provided to the motor of the machine 26. The velocity servo gains are set in a known manner under most circumstances to provide desired elevator system performance.

Under some circumstances, it will be necessary to re-level the elevator car 22 when it is stopped at a landing. In the case of a high rise building, when the elevator car 22 is at a relatively low landing, the extended length of the roping arrangement 28 introduces additional control challenges as described above. The example controller 30 utilizes an adjusted velocity servo gain to achieve a desired re-leveling performance when the elevator car 22 is at a landing where conventional re-leveling techniques alone may not provide the desired results.

The illustrated example includes at least one vibration damper 40 supported for movement with the elevator car 22. The vibration dampers 40 in this example are supported on each side of the elevator car 22. The vibration dampers 40 are configured to engage a stationary surface when the elevator car 22 is stopped at a landing to dampen vertical movement of the elevator car 22 under such conditions. In a described example, the vibration dampers 40 are used during a re-leveling procedure. For such purposes, the vibration dampers 40 are considered leveling vibration dampers as they dampen vibrations during elevator car leveling.

Figure 2:
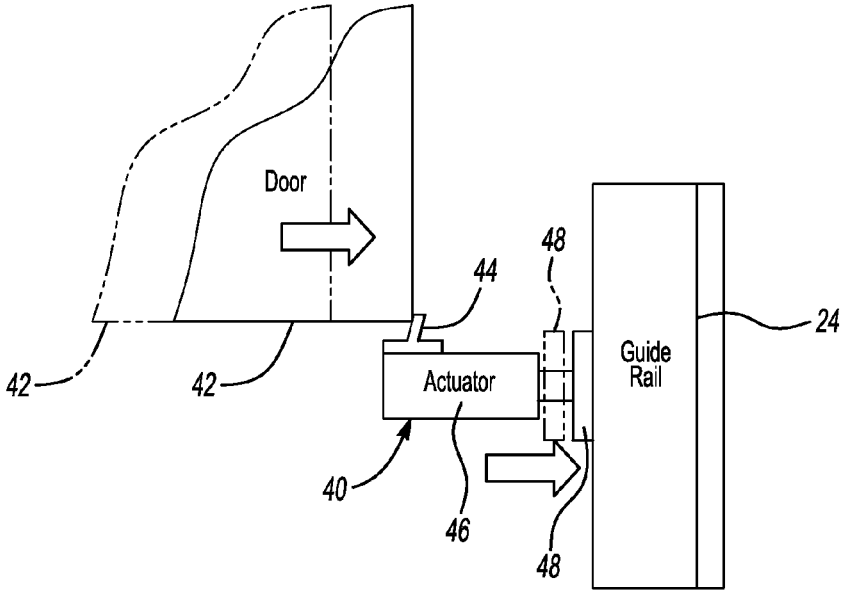
FIG. 2 schematically shows an example vibration damper arrangement.

FIG. 2 schematically illustrates an example vibration damper configuration. The vibration damper 40 in this example is activated responsive to an elevator car door 42 moving from a closed position (shown in phantom) into an open position. A triggering mechanism 44 such as a switch or a detector provides an indication when the elevator car door 42 moves into the open position. There are known techniques for determining when an elevator door is open and some examples use such techniques. The open elevator car door is interpreted as an indication that the elevator car 22 is at a landing where it is desired to keep the elevator car at least temporarily. In some cases it might be advantageous to also require a floor landing detection signal to be included in the vibration damping control system logic so that it is only deployed at the lowest level floors in a high rise elevator system where the extensive rope lengths between the car and the machine near the top of the hoistway compromise conventional re-leveling control system performance. In one such example, the door detection device 44 and a floor detection device must both be activated to enable the vibration damper to be engaged.

An actuator 46 moves a friction member 48 into engagement with a surface on the guide rail 24 responsive to the indication that the elevator car door 42 is open (and the floor detector is also enabled if a floor detector is utilized). In one embodiment, the frictional engagement between the friction member 48 and the guide rail 24 serves to resist vertical movement of the elevator car 22 while parked at a landing. Resisting vertical movement in this example is distinct from stopping all such movement. The vibration dampers 40 reduce vibrations associated with changes in a load of the elevator car 22 during passenger loading or unloading, for example. Reducing vibrations in this example does not have the effect of fixing the elevator car 22 to the landing or rail 24 during passenger loading and unloading.

Figure 3:
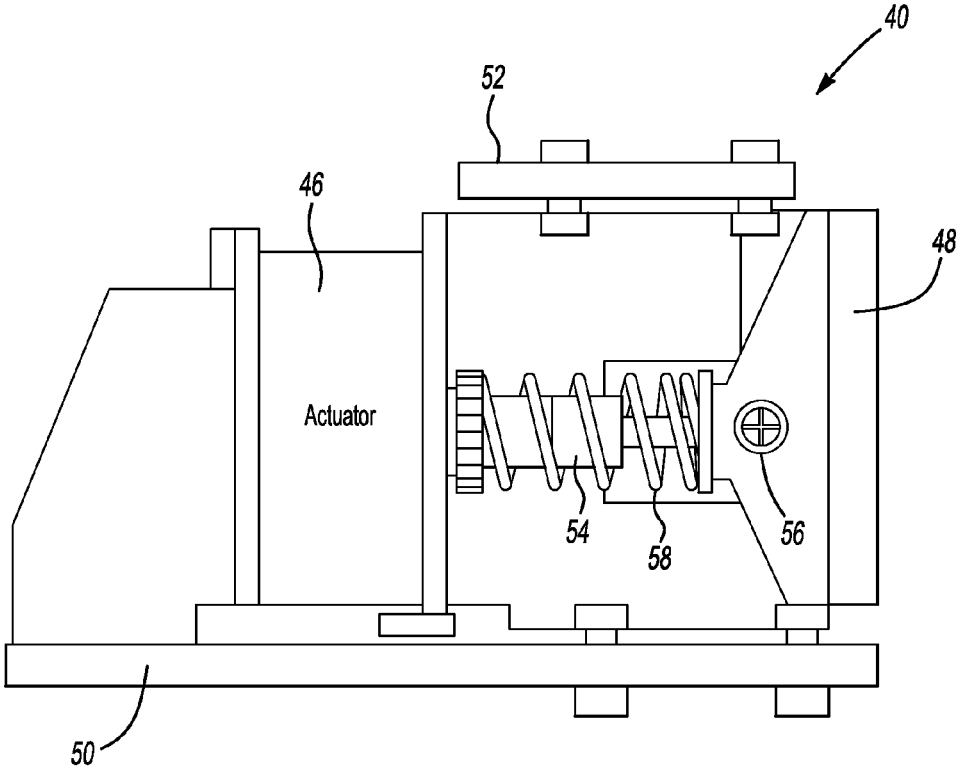
FIG. 3 schematically illustrates another example vibration damper.

FIG. 3 diagrammatically illustrates one example vibration damper 40. In this example, mounting brackets 50 and 52 are provided for securing the vibration damper 40 in a selected position relative to the elevator car 22. The actuator 46 controls movement of an arm 54 for selectively moving the friction member 48 into or out of engagement with a stationary surface such as the corresponding one of the guide rails 24. In the illustrated example, the friction member 48 is pivotally supported relative to the arm 54 such that it can pivot about a pivot axis 56. The pivotal movement of the friction member 48 compensates for any misalignment between the engaging surface of the friction member 48 and the orientation of the surface on the guide rail 24 engaged by the friction member 48.

This example also includes a mechanical spring 58 for controlling the amount of pressure applied by the friction member 48 against the guide rail surface. Example actuators 46 include solenoids and electric motors. The size of the spring 58 and the forces provided by the actuator 46 provide sufficient frictional engagement between the friction member 48 and the stationary surface to provide sufficient vertical damping forces for resisting vertical movement of the elevator car 22. The actuator 46 in one example comprises a threaded rod that is moveable in a linear direction responsive to rotary motion.

Figure 4:
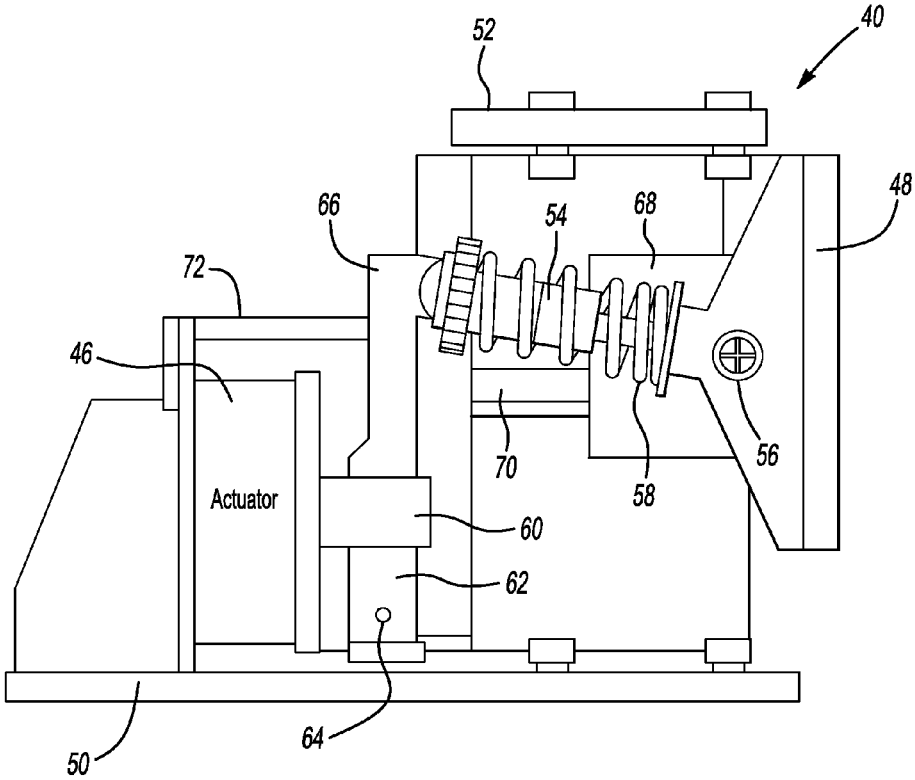
FIG. 4 schematically illustrates another example vibration damper.

FIG. 4 diagrammatically illustrates another example vibration damper 40. In this example, the actuator 46 moves a first arm 60. A pivot linkage 62 is coupled with the first arm 60. The pivot linkage 62 pivots about a pivot point 64, which in this example remains stationary relative to the mounting bracket 50. The pivot point 64 is located near one end of the pivot linkage 62. An opposite end 66 of the pivot linkage 62 is coupled with the arm 54, which is referred to as a second arm in this example.

As the actuator 42 moves the first arm 60, the pivot linkage 62 pivots causing the second arm 54 and the friction member 48 to move into or out of engagement with the stationary surface such as a surface on the guide rail 24. This example includes a mounting plate 68 and guiding surface 70 for guiding movement of the friction member 48. The friction member 48 is supported for pivotable movement about the pivot axis 56 in this example. The pivot axis 56 moves with the plate 68 (e.g., from left to right in the drawing) so that the friction member 48 moves with the plate 68 and relative to the plate 68.

Using the pivot linkage 62 allows for increasing the movement of the damping pad available from operation of the actuator 42 without requiring an increased size or power of the actuator 42. The example of FIG. 4 includes a return spring 72 that urges the second end 66 of the pivot linkage 62 in a direction for moving the friction member 48 out of engagement with the corresponding one of the guide rails 24 when the actuator is turned off or does not exert a force on the first arm 60.

The example vibration dampers 40 are useful during a re-leveling operation for resisting vertical movement or vibration of the elevator car 22. The vibration dampers 40 allow for improved motor control to achieve improved re-leveling performance. For example, it is possible to use increased gains for motor torque commands for controlling operation of the motor 26 during a re-leveling procedure. This allows for increased bandwidth of the dynamic position control system. Without the vibration dampers 40, it may be possible to undesirably excite a resonant frequency of the elevator roping arrangement 28, for example, when using an increased gain for motor control. When the vibration dampers 40 are activated (i.e., the friction members 48 are moved into a position to engage the guide rails 24), the example controller 30 adjusts the gain used for motor control while re-leveling.

Figure 5:
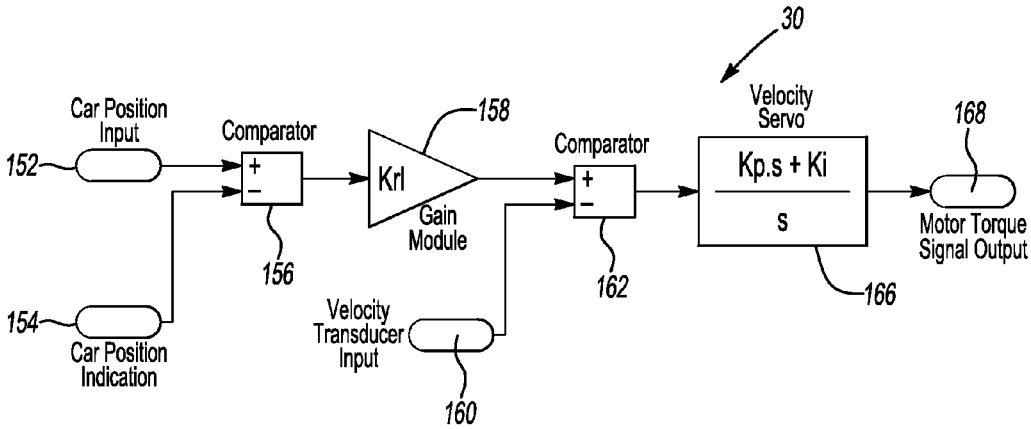
FIG. 5 schematically illustrates an example elevator control arrangement.

FIG. 5 schematically illustrates an example elevator control configuration where a portion of the controller 30 is schematically represented. In this example, conventional elevator motor control techniques are used for providing control signals to operate the motor of the machine 26 under most elevator system operating conditions. When re-leveling is required and the vibration dampers 40 are activated, the gain associated with the motor control is adjusted to provide desired re-leveling performance.

In FIG. 5, a desired elevator car position input 152 is compared with an actual elevator car position indication 154 using a comparator 156. The output of the comparator 156 (i.e., any difference between the actual and desired positions of the elevator car) is processed by a re-leveling gain module 158. In one example, the re-leveling gain is adjusted depending on whether the vibration dampers 40 are activated. The output of the re-leveling gain module 158 is compared with a primary velocity transducer input 160 in a comparator 162.

The output of the comparator 162 is provided to a velocity servo 166. The control in this example adjusts at least one of the re-leveling gain and the velocity servo gains ($K_p$ and $K_i$) used for a motor torque signal if the vibration dampers 40 are activated. In one example, the control increases at least one of the gains to a higher value than a set baseline value for that gain. In the illustrated example, all of the gains are increased to improve re-leveling performance, for example.

In one example, first leveling gain values are used during a re-leveling procedure when the vibration dampers 40 are not activated and second, different leveling gains are used when the vibration dampers 40 are activated. In this example, the second gains are higher than the first gains.

The gains are increased in this example when the vibration dampers 40 are activated to dampen vertical movement of the elevator car 22. The increased gains provide improved performance during re-leveling of the elevator car 22. The velocity servo 166 provides a motor torque signal output 168 that is used for controlling the motor of the machine 26 during re-leveling. Using a higher gain for the motor torque allows for faster re-leveling, for example. Another example improves re-leveling by achieving a reduced magnitude of vertical corrections in elevator car position.

If the gain(s) were increased without having the vibration dampers 40 activated to resist vertical movement of the elevator car 22, it would be possible to excite the resonant frequency of the elevator roping arrangement 28, for example, which would introduce vibration or bouncing of the elevator car. Utilizing the vibration dampers 40 during a re-leveling procedure allows for adjusting the re-leveling gain and the velocity servo gain to provide improved re-leveling performance while avoiding exciting the hoistway components. The additional elevator car position control provided by the vibration dampers 40 effectively minimizes the excitation of the elevator vertical vibration mode while still allowing for higher velocity servo gains and improved re-leveling to be realized.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling elevator car position, comprising:

determining that an elevator car requires re-leveling from a current vertical position to a desired vertical position;

determining whether a vibration damper is activated; and adjusting a gain for controlling operation of a motor responsible for moving the elevator car for the re-leveling if the vibration damper is activated.

2. The method of claim 1, comprising generating a motor torque signal for controlling the motor for moving the elevator car to accomplish the re-leveling using the adjusted gain.

3. The method of claim 1, comprising using the adjusted gain when moving the elevator car during re-leveling; and using a different, default gain during other elevator operation conditions.

4. The method of claim 1, comprising using a first gain if the vibration damper is not activated; and using a second, different gain if the vibration damper is activated.

5. The method of claim 4, wherein the second gain has a higher value than the first gain.

6. The method of claim 1, wherein the adjusted gain is at least one of a re-leveling gain or a proportional integral gain of a velocity servo associated with the motor.

7. The method of claim 1, comprising activating the vibration damper responsive to an elevator car door opening.

8. The method of claim 7, wherein the leveling damper comprises an actuator and a friction member that is moveable by the actuator into a position to engage a stationary surface for limiting an amount of vertical movement of the elevator car during the re-leveling.

9. The method of claim 8, wherein the actuator moves the friction member in a first direction and the friction member is supported for pivotal movement relative to the first direction.

10. The method of claim 7, wherein the vibration damper comprises a first arm that is moved by the actuator;

a pivot linkage coupled to the arm for pivotal movement about a pivot axis near one end of the pivot linkage responsive to movement of the first arm; and a second arm coupled to the pivot linkage near an opposite end of the pivot linkage such that the second arm moves responsive to movement of the pivot linkage, the friction member being supported for movement with the second arm and for pivotal movement relative to a direction of movement of the second arm.

11. An elevator positioning system, comprising:

a vibration damper that is configured to resist vertical movement of an associated elevator car; and a controller device for controlling a motor configured to move the associated elevator car vertically along a hoistway, the controller device having a gain with a set value, the controller device being configured to selectively adjust the gain from the set value during a re-leveling of the associated elevator car from a current vertical position to a desired vertical position if the vibration damper is activated.

12. The elevator system of claim 11, wherein the controller device increases the gain to a second, re-leveling value that is higher than the set value if the vibration damper is activated.

13. The elevator system of claim 11, wherein the controller generates a motor torque signal using the adjusted gain.

14. The elevator system of claim 13, wherein the controller generates the motor torque signal using the adjusted gain for re-leveling an elevator car if the vibration damper is activated and otherwise uses the set value of the gain.

15. The elevator system of claim 11, wherein the gain is at least one of a re-leveling gain or a proportional integral gain of a velocity servo.

16. The elevator system of claim 11, wherein the vibration damper is configured to be activated responsive to a door of the associated elevator car opening.

17. The elevator system of claim 11, wherein the vibration damper comprises an actuator;

a friction member that is supported to be moved along a first direction by the actuator into a position to engage a stationary surface, the friction member being supported to pivotally move relative to the first direction.

18. The elevator system of claim 17, wherein the vibration damper comprises a first arm that is moved by the actuator;

a pivot linkage coupled to the arm for pivotal movement about a pivot axis near one end of the pivot linkage responsive to movement of the first arm; and a second arm coupled to the pivot linkage near an opposite end of the pivot linkage such that the second arm moves responsive to movement of the pivot linkage, the friction member being supported for movement with the second arm and for pivotal movement relative to a direction of movement of the second arm.

19. The elevator system of claim 11, comprising:

an elevator car having the vibration damper supported on a portion of the elevator car;

a roping arrangement secured to the elevator car; and a motor for moving the roping arrangement to cause movement of the elevator car responsive to the controller device.

* * * * *